US007653958B2

(12) United States Patent
Rosenzweig et al.

(10) Patent No.: US 7,653,958 B2
(45) Date of Patent: Feb. 2, 2010

(54) MULTI-DIRECTIONAL ACTUATOR FOR A PUMP

(75) Inventors: Maximilian Rosenzweig, Montreal (CA); Ognjen Vrdoljak, Laval (CA)

(73) Assignee: Euro-Pro Operating, LLC, West Newton, MA (US)

( * ) Notice: Subject to any disclaimer, the term of this patent is extended or adjusted under 35 U.S.C. 154(b) by 0 days.

(21) Appl. No.: 12/014,898

(22) Filed: Jan. 16, 2008

(65) Prior Publication Data

US 2009/0178697 A1 Jul. 16, 2009

(51) Int. Cl.
*A47L 7/00* (2006.01)
*F04B 19/00* (2006.01)

(52) U.S. Cl. ..... 15/49.1; 15/98; 15/320; 15/322; 417/470; 417/535; 417/566; 134/198

(58) Field of Classification Search ..... 15/49.1, 15/98, 320–322; 417/470, 535, 566; 134/173, 134/184, 198; *A47L 7/00; F04B 19/00*
See application file for complete search history.

(56) References Cited

U.S. PATENT DOCUMENTS

| | | | | |
|---|---|---|---|---|
| 1,720,165 | A | 7/1929 | Bloom | |
| 2,053,282 | A * | 9/1936 | Gewalt | 401/138 |
| 4,073,030 | A | 2/1978 | Albishausen | |
| 4,074,387 | A | 2/1978 | Arato et al. | |
| 4,327,459 | A | 5/1982 | Gilbert | |
| 4,584,736 | A | 4/1986 | Gremminger | |
| 4,905,712 | A | 3/1990 | Bowlin et al. | |
| 5,165,866 | A | 11/1992 | Kato | |
| 6,289,551 | B1 | 9/2001 | Basile | |
| 6,490,753 | B1 | 12/2002 | Chen | |
| 6,571,421 | B1 | 6/2003 | Sham et al. | |
| 7,380,307 | B2 | 6/2008 | Tsai | |
| 2002/0094285 | A1 | 7/2002 | Paolini et al. | |
| 2002/0106970 | A1 | 8/2002 | Falla | |

(Continued)

FOREIGN PATENT DOCUMENTS

| | | |
|---|---|---|
| CH | 429 211 A | 1/1967 |

(Continued)

OTHER PUBLICATIONS

Patent Abstracts of Japan, vol. 2002, No. 03, Apr. 3, 2002, Publication No. 2001327449 (Alpha Homes: KK), Nov. 21, 2001.

(Continued)

*Primary Examiner*—David A Redding
(74) *Attorney, Agent, or Firm*—McCarter & English, LLP; Michael I. Wolfson

(57) ABSTRACT

A steam mop having a main body including a water pump for pumping water from a water tank to a steam generator in response to any movement of the mop is provided. Movement of the mop causes a pump actuator to slide within a frame. The actuator has a camming surface with a pump piston rod biased against the camming surface that causes the pump piston rod to move in and out of a pump cylinder when the actuator moves. This operates a the pump to pump water to the steam generator for feeding steam to a steam pad mounted on a mop steam frame connected to the steam generator outlet.

8 Claims, 9 Drawing Sheets

U.S. PATENT DOCUMENTS

| | | | | |
|---|---|---|---|---|
| 2002/0112744 | A1 | 8/2002 | Besseling | |
| 2003/0089383 | A1 | 5/2003 | Biggs | |
| 2004/0134016 | A1 | 7/2004 | Kisela | |
| 2005/0259382 | A1* | 11/2005 | Ducruet et al. | 361/600 |
| 2006/0000049 | A1 | 1/2006 | Rosenzweig | |
| 2007/0130719 | A1* | 6/2007 | Zhou | 15/320 |

FOREIGN PATENT DOCUMENTS

| | | | |
|---|---|---|---|
| CN | 1368032 | A | 9/2002 |
| CN | 2540155 | Y | 3/2003 |
| CN | 2568117 | Y | 8/2003 |
| DE | 24 31 102 | A1 | 1/1976 |
| DE | 91 10 171 | U1 | 3/1993 |
| DE | 298 22 052 | U1 | 2/1999 |
| DE | 299 10 658 | U1 | 9/1999 |
| DE | 200 01 462 | U1 | 1/2001 |
| DE | 100 15 941 | A1 | 10/2001 |
| DE | 102 05 507 | A1 | 8/2003 |
| DE | 20 2006 001189 | U1 | 4/2006 |
| EP | 1 027 855 | A | 8/2000 |
| EP | 1 224 899 | A | 7/2002 |
| EP | 1 554 968 | A | 7/2005 |
| FR | 601 312 | A | 2/1926 |
| FR | 709 689 | A | 8/1931 |
| FR | 2 282 252 | A | 3/1976 |
| GB | 1 449 483 | | 8/1973 |
| GB | 2 294 196 | A | 4/1996 |
| GB | 2 416 526 | A | 2/2006 |
| JP | 2001327449 | A | 11/2001 |
| JP | 2004337454 | A | 12/2004 |
| WO | WO 98/23385 | A | 6/1998 |
| WO | WO 99/26522 | A | 6/1999 |
| WO | WO 02/43550 | A | 6/2002 |
| WO | WO 2007/065371 | A | 6/2007 |

OTHER PUBLICATIONS

Euro-Pro Operating LLC; Steam Shark II Owner's Manual Model EP908EF; Nov. 2003; St. Laurent, Quebec H4S 1A7, pp. 1-39.

Euro-Pro Operating LLC; Portable Shark Steam Cleaner Owner's Manual Model SC505; Jan. 2003; p. 7; Champlain, NY 12919, pp. 1-11.

* cited by examiner

MULTI-DIRECTIONAL ACTUATOR FOR A PUMP

BACKGROUND OF THE INVENTION

The invention relates generally to an actuator, and more particularly to a pump actuator particularly suited for a steam mop including a water pump that is actuated by movement of the mop handle in any direction to pump water from a reservoir to a boiler for generating steam to be distributed to a steam nozzle for cleaning.

Conventional mops have been widely used for cleaning floors. However, conventional mops have not been effective at cleaning dirt in small crevices and floor gaps. In addition, conventional mops require frequent rising since mops can only effectively clean a small surface area at a time.

Steaming devices used to apply steam to household objects are well known. The uses of the devices vary widely, and may include the application of steam to drapes or other fabrics to ease wrinkles, and the application of steam to objects to assist in cleaning the objects.

In general, the nozzles used with the steam cleaners do not have large surface areas and a cloth to absorb the liquid condensate of the steam. Here, the fabric pad is secured to the nozzle by Velcro strips to a plurality of cleats on the bottom of the nozzle. In another embodiment, a flat fabric piece is folded around a flat brush or nozzle in order to increase the cleaning surface area. The folded fabric on top of the brush or nozzle is secured by a clip on top of the piece. Often steam injected behind the cloth passes through the cloth at the points the bristles contact on the cloth. This tends to wet the cloth and reduce the cleaning effectiveness of the steam. In addition, the cloth covers must be carefully attached not to cover the front or back of the brush attachment.

Newly designed steam mops pump water from a reservoir to a boiler by the push-pull movement of the mop handle. This push-pull movement actuates a one-way pump connected directly to the handle. It remains desirable to provide an actuator that will pump water from the reservoir to the steam boiler in response to any movement of the mop.

SUMMARY OF THE INVENTION

Generally speaking, in accordance with the invention, an actuator for a pump is provided. The actuator is disk-shaped and connected to a mop handle that moves the actuator in a direction parallel to the cleaning surface. The mop includes a water pump for selectively pumping water from a water tank to a steam generator in response to movement of the handle in any direction. One surface of the actuator has a depression with an arcuate inner camming surface that moves a piston in the water pump when the actuator moves in any direction. This pumps water to the steam generator for distribution of steam to the cleaning surface.

The actuator is particularly well suited to be connected to the handle of a steam mop having a steam frame with a steam towel pad mounted on the frame for cleaning. As the mop is moved during use, water is pumped to the steam generator to be fed to the mop frame. This gives the user greater control over when water is pumped than in many of the earlier push-pull steam mop proposals.

Accordingly, it is an object of the invention to provide an improved pump actuator.

Another object of the invention is to provide a steam mop having an actuator allowing a user to control when water is pumped to the boiler.

A further object of the invention is to provide a steam mop with a mechanical pump that is actuated by movement of the mop in any direction.

Still other objects and advantages of the invention will in part be obvious and will in part be apparent from the specification.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is made to the following description taken in connection with the accompanying drawing(s), in which.

DETAILED DESCRIPTION OF THE INVENTION

Figure 1:
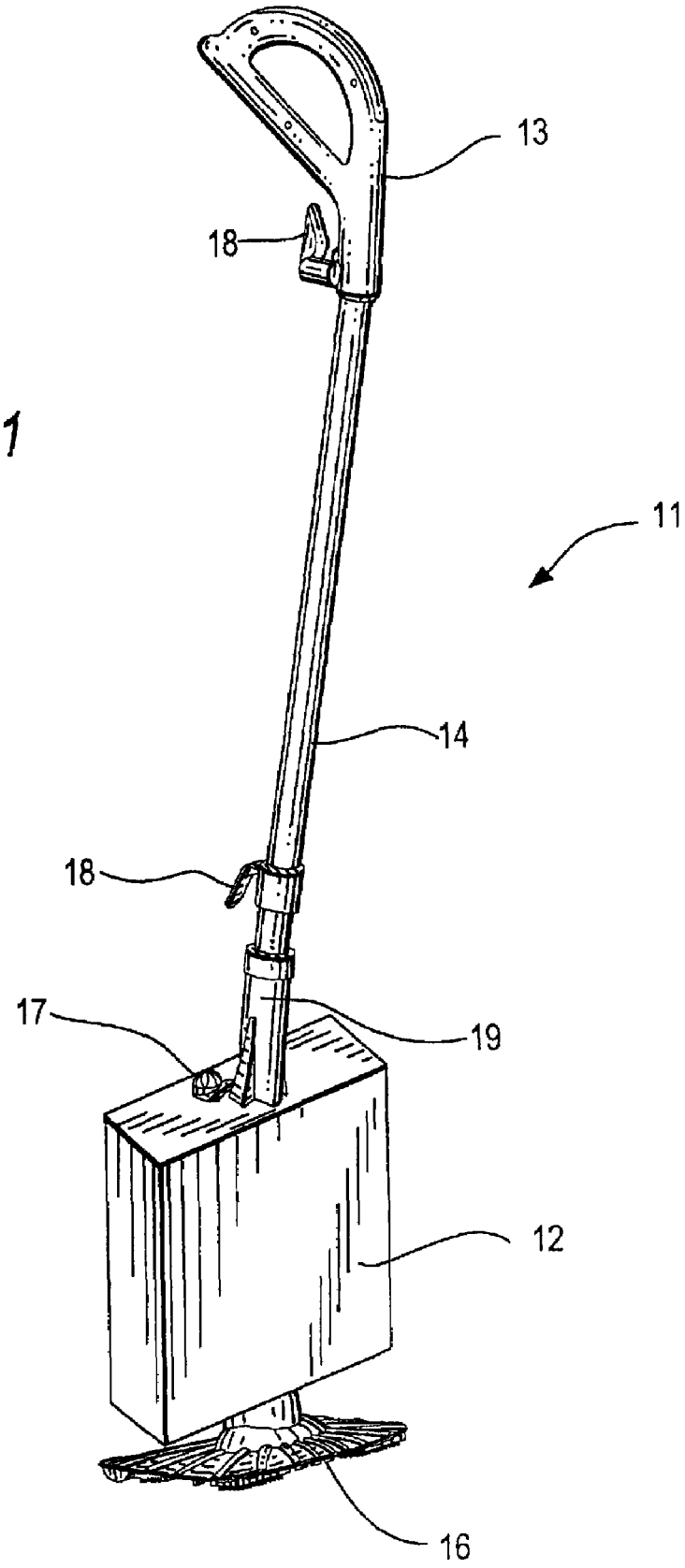
FIG. 1 is a perspective view of a steam mop incorporating an actuator in accordance with the Invention.

FIG. 1 is a perspective view of a steam mop 11 constructed and arranged in accordance with the invention. Mop 11 includes a housing 12 connected to a user handle 13 by a pole 14 at the top thereof. A steam frame 16 is fixed to the bottom of housing 12. Housing 12 includes a water inlet 17 a pair of electric cord holders 18 at the bottom of user handle 13 and at the bottom of pole 14.

Figure 2:
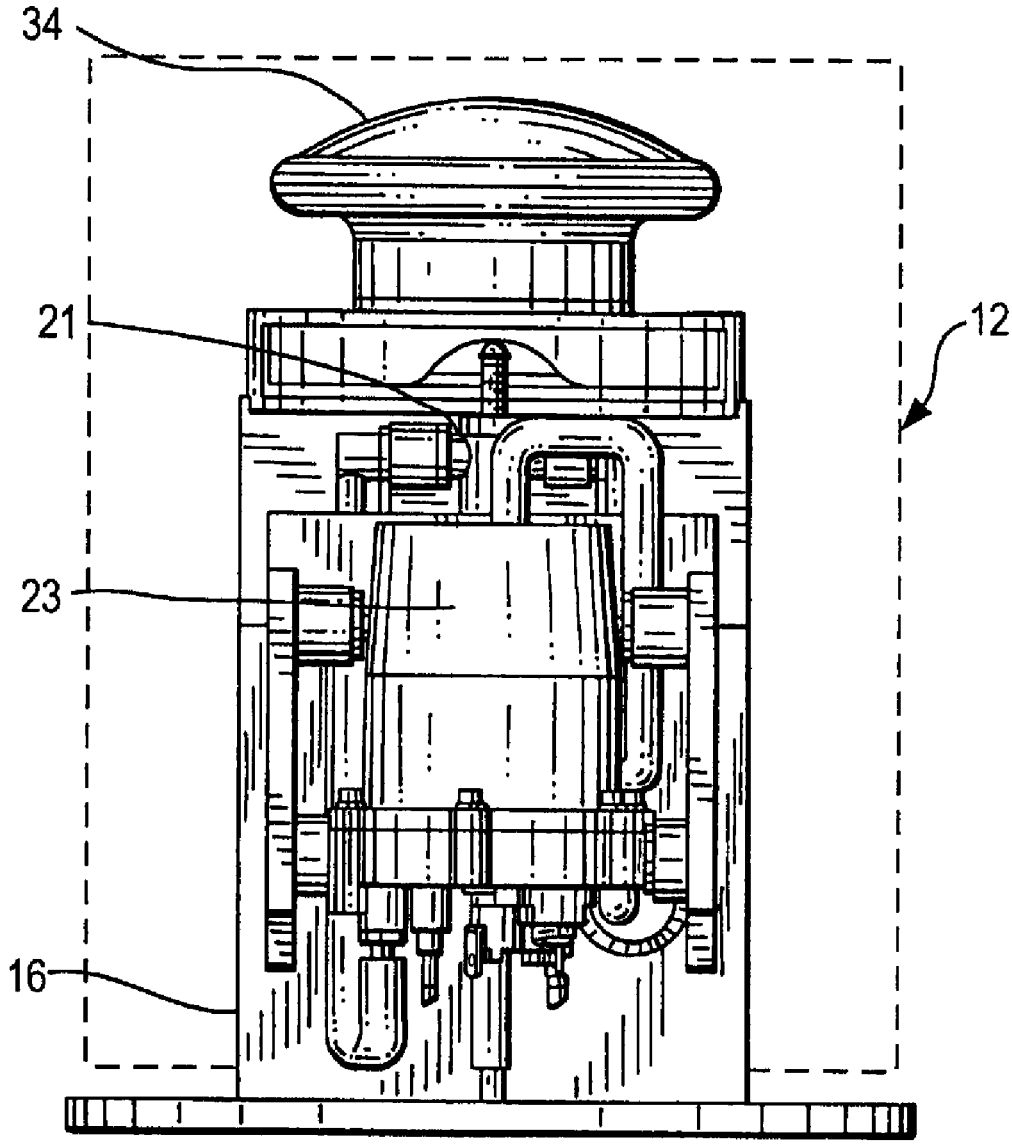
FIG. 2 is a front schematic view of the housing steam mop of FIG. 1 in section including a pump actuator constructed and arranged in accordance with the invention operatively connected to a pump connected to a water tank and steam generator for feeding steam to a towel frame.
Figure 3:
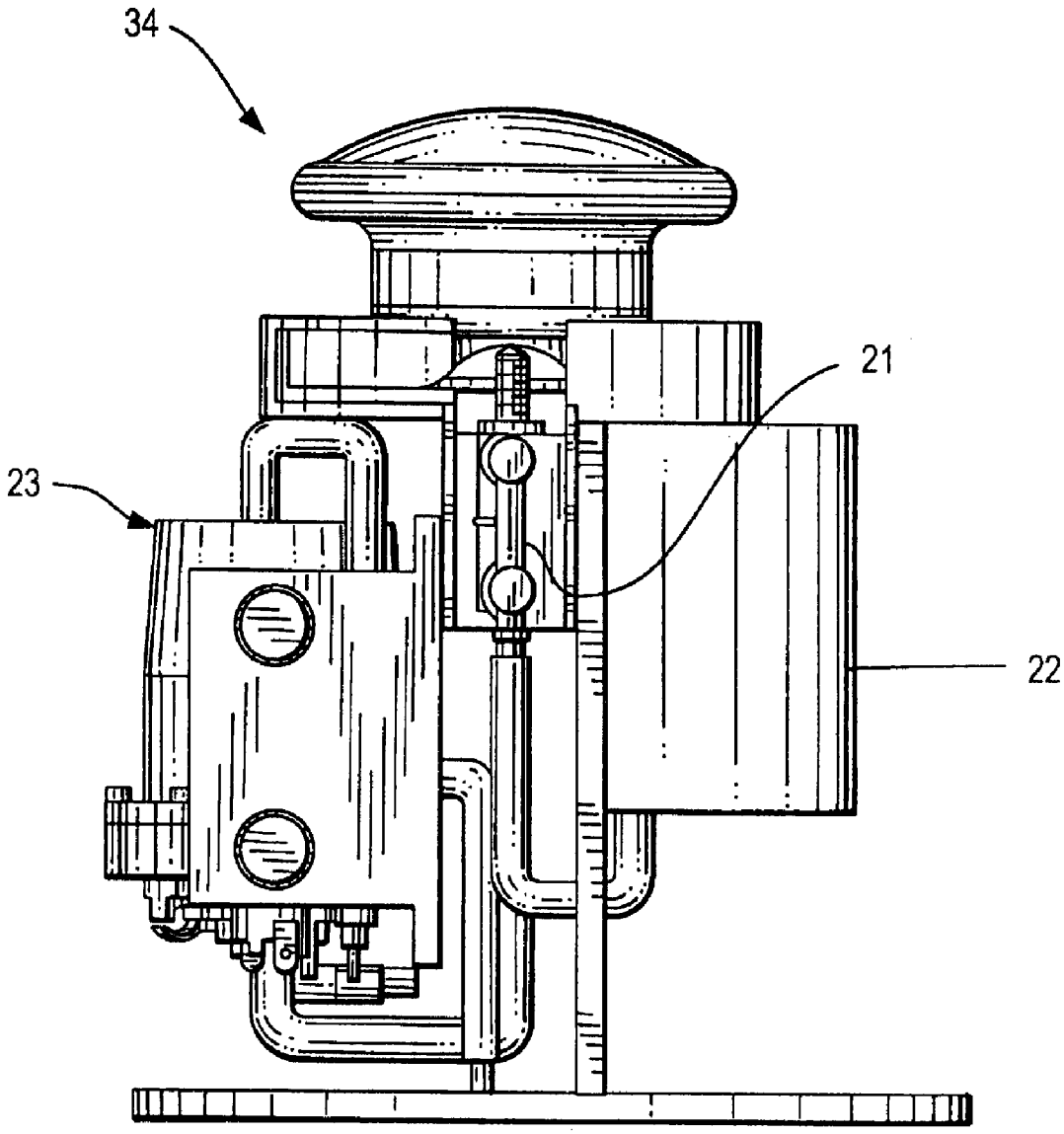
FIG. 3 is a side elevational view of the steam mop of FIGS. 1 and 2 showing the water tank and boiler.

Housing 12 includes a water pump 21 connecting a water tank 22 to a boiler or steam generator 23 as shown in FIGS. 2 and 3.

Figure 4:
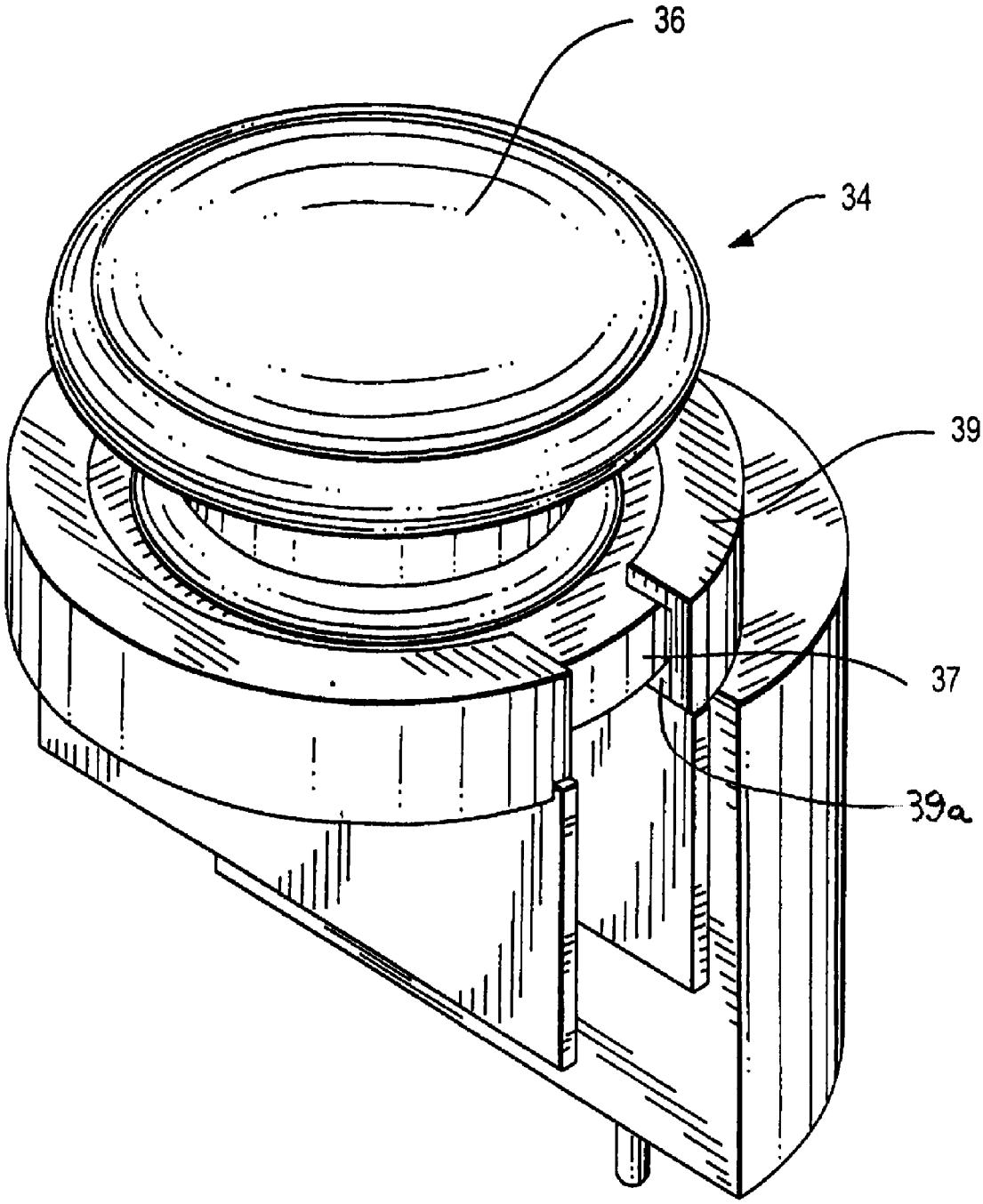
FIG. 4 is a perspective view in schematic of a pump actuator seated within an actuator frame in the steam mop of FIGS. 1-3.
Figure 7:
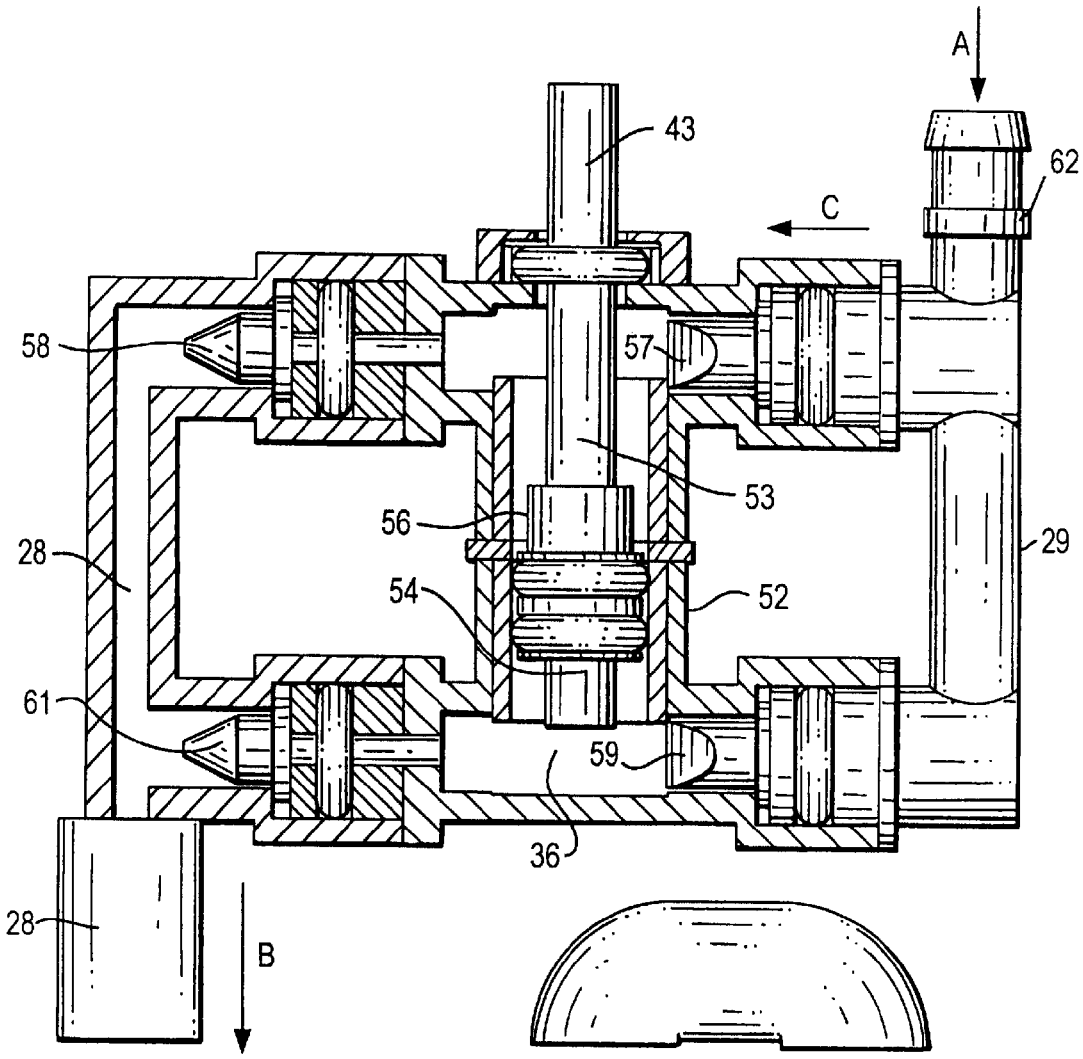
FIG. 7 is a sectional view of a two way pump suitable for use in the steam mop in FIGS. 1-3.

Pump 21 is a two-way pump that pumps water in response to up or down movement of a piston 56 (shown in FIG. 7). Pump 21 is actuated by movement of a pump actuator 34 shown in perspective in FIG. 4. Here, actuator 34 is a substantially planar disk having an actuator top with an upper handle portion 36 and a lower flange portion 37 connected by an actuator neck 38. Actuator 34 sits in a groove 39*a* of an actuator frame 39 at the top of housing 12 above pump 21 for receiving actuator flange 38. Groove 39*a* is circular and allows for movement of flange 37 in all transverse directions parallel to a surface being cleaned.

Any type of mechanical pump or some other means of feeding water to the boiler may be used with steam mop 11. Preferably, pump 21 is a two-way mechanical pump, such as a bellows pump or a piston pump, that is actuated by movement of mop handle 12. A pump outlet hose 28 is connected to boiler 23 for generating steam to be distributed to steam frame 16 by a steam pipe 32.

Figure 5:
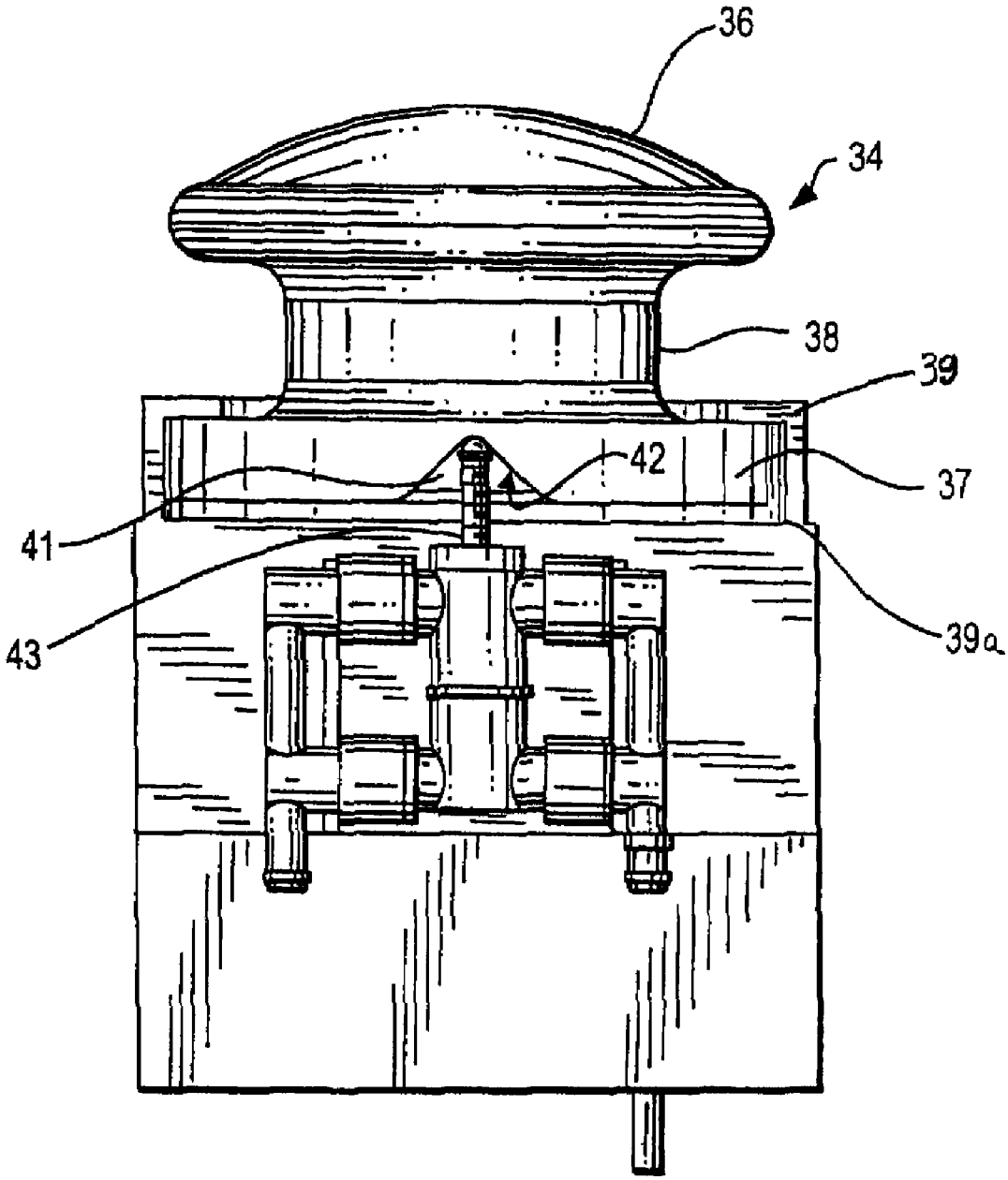
FIG. 5 is an elevational view in schematic of the actuator and pump.

As shown in FIG. 5. actuator flange 37 has on its bottom surface a depression 41 to form an accurate camming surface 42 that contacts a piston rod 43 biased against camming surface 42 of pump 21.

Figure 6B:
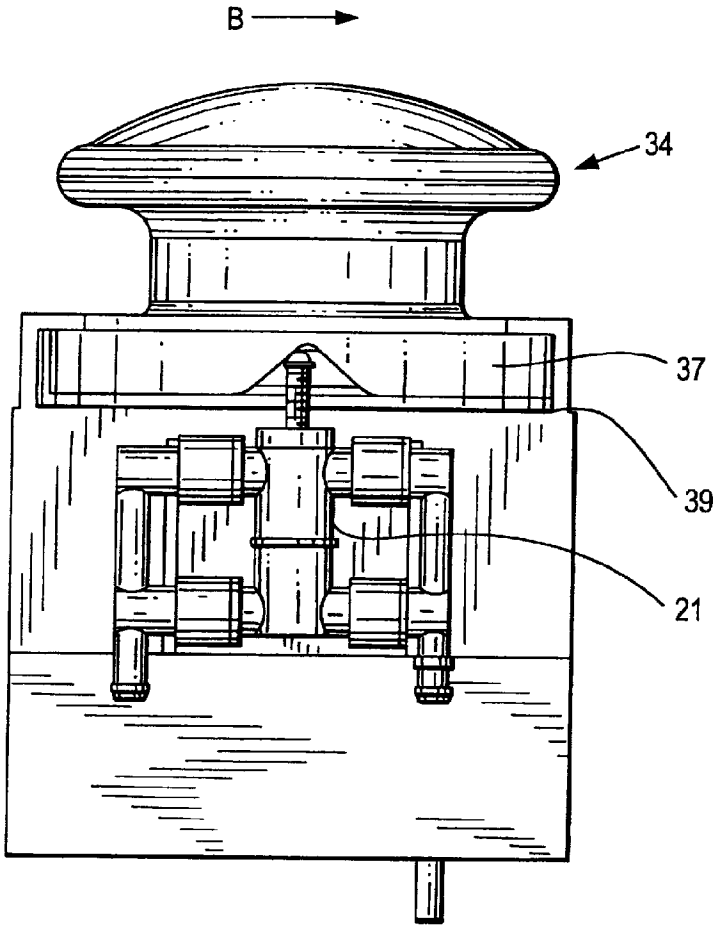
FIGS. 6A and 6B show how movement the actuator operates the pump by displacement of the pump piston.
Figure 6A:
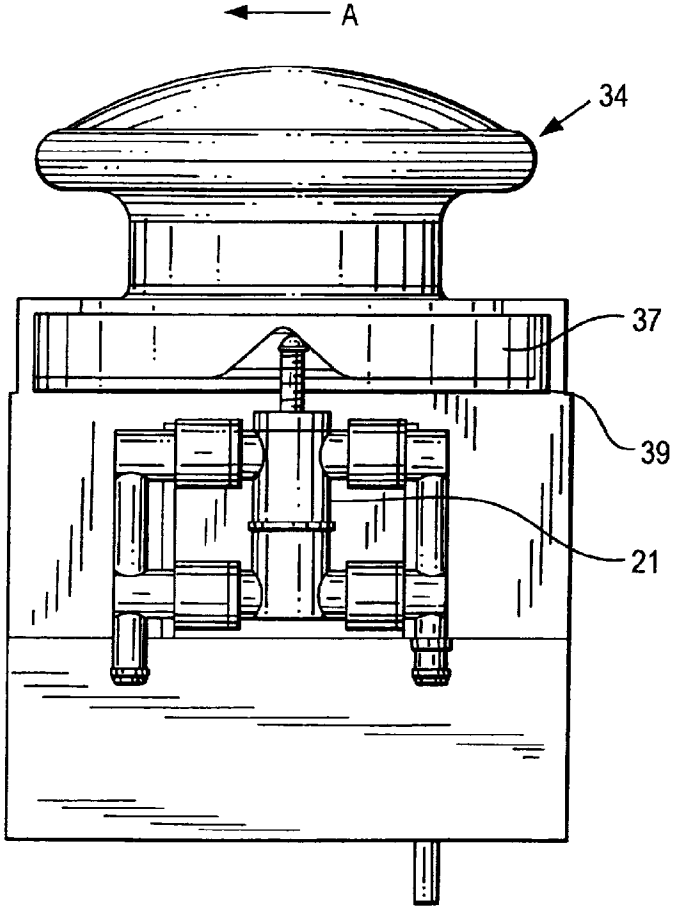

Referring now to FIGS. 6A and 6B, movement of actuator 34 to the left as shown in FIG. 6A by an arrow A depresses piston rod 43 into pump 21. Similarly, movement to the right as shown by an arrow B in FIG. 6B also moves flange 37 within groove 39*a* and depresses piston rod 43 into pump 21. The operation of pump 21 will now be described in detail.

Referring now to FIG. 7, movement of piston rod 43 upwardly or downwardly causes water to be pumped from pump 21. Pump 21 will pump water when handle 13 is displaced both in any transverse direction as piston rod 43 is displaced. Pump 21 includes a pump cylinder 52 having an upper chamber 53 and a lower chamber 54 divided by a piston 56 that is connected to piston rod 43 which moves up and down in response to movement of handle 13 and actuator flange 37.

A first unidirectional inlet duck bill valve 57 and a first unidirectional outlet duck bill valve 58 are connected to upper chamber 53. A second unidirectional inlet duck bill valve 59 and a second unidirectional outlet duck bill valve 61 are connected to lower chamber 54. As shown in FIG. 7, both inlet duck bill valves 57 and 59 are connected in parallel to water inlet pipe 29 having a water inlet fitting 62 for securing hose 28 from water tank 22. Water outlet duck bill valves 58 and 61 are connected in parallel to a water outlet pipe 28 that is connected to boiler 23 at inlet 29. In order to create the pumping action to force water out of valves 58 and 61, volume changes in chambers 53 and 54 must be created.

A steam hose 32 is connected to boiler 23 that may be a steam generator be a of any suitable design, which can be used to generate and feed steam to steam frame 16 for distribution in a desired pattern.

As piston 56 moves downward, the volume of lower chamber 54 decreases which causes the water which is inside to exit chamber 54 through duck bill valve 58. Water flow direction is determined by the direction of duck bill valve as water can flow only in one direction through the valve. At the same time water flows through outlet valve 58, the volume of upper chamber 53 increases. This increase of the volume causes water to flow from reservoir 22 into chamber 53 through inlet duck bill valve 57 as shown by arrow C.

Figure 8:
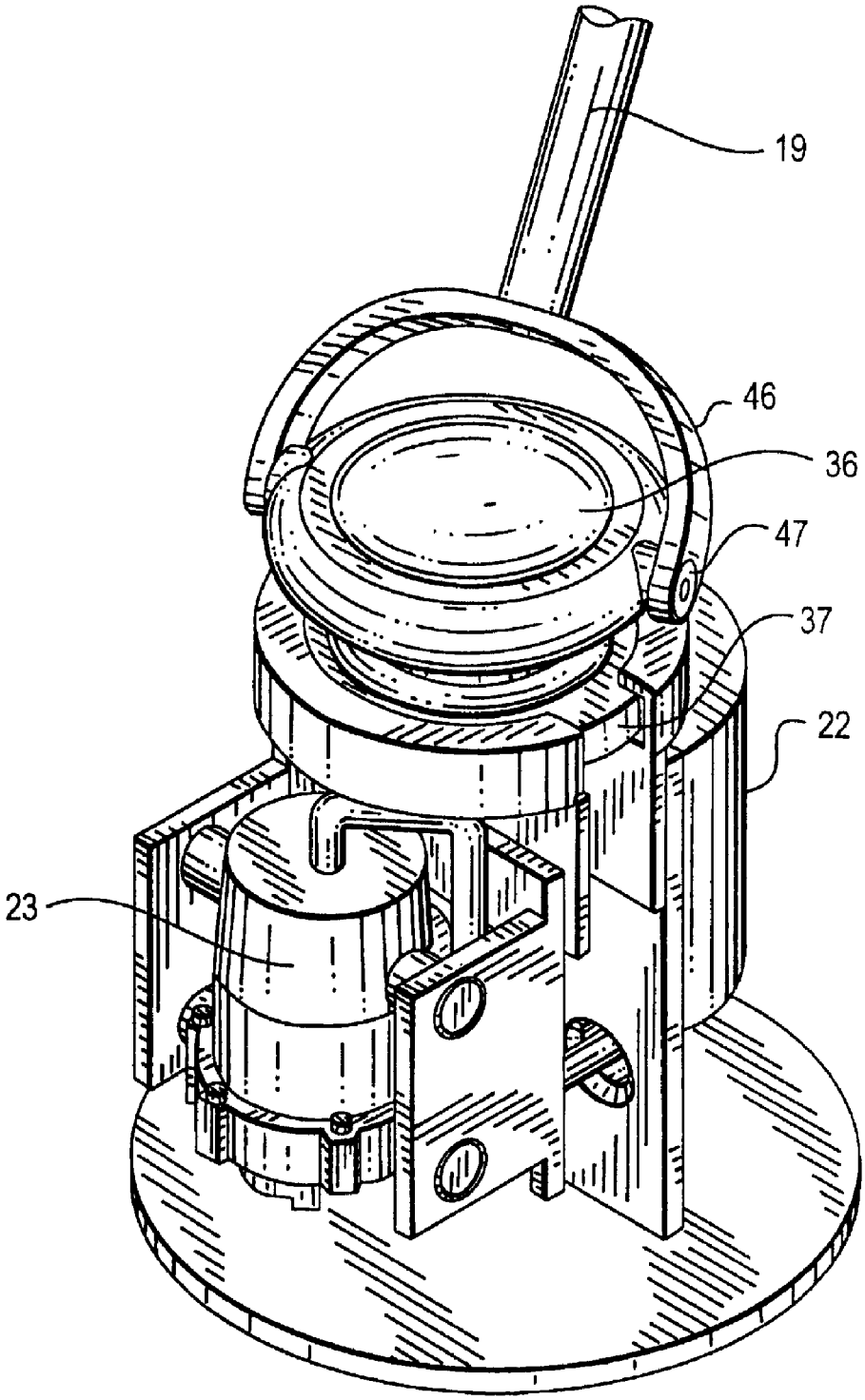
FIG. 8 is a perspective view showing how the mop handle is connected to the actuator.
Figure 9:
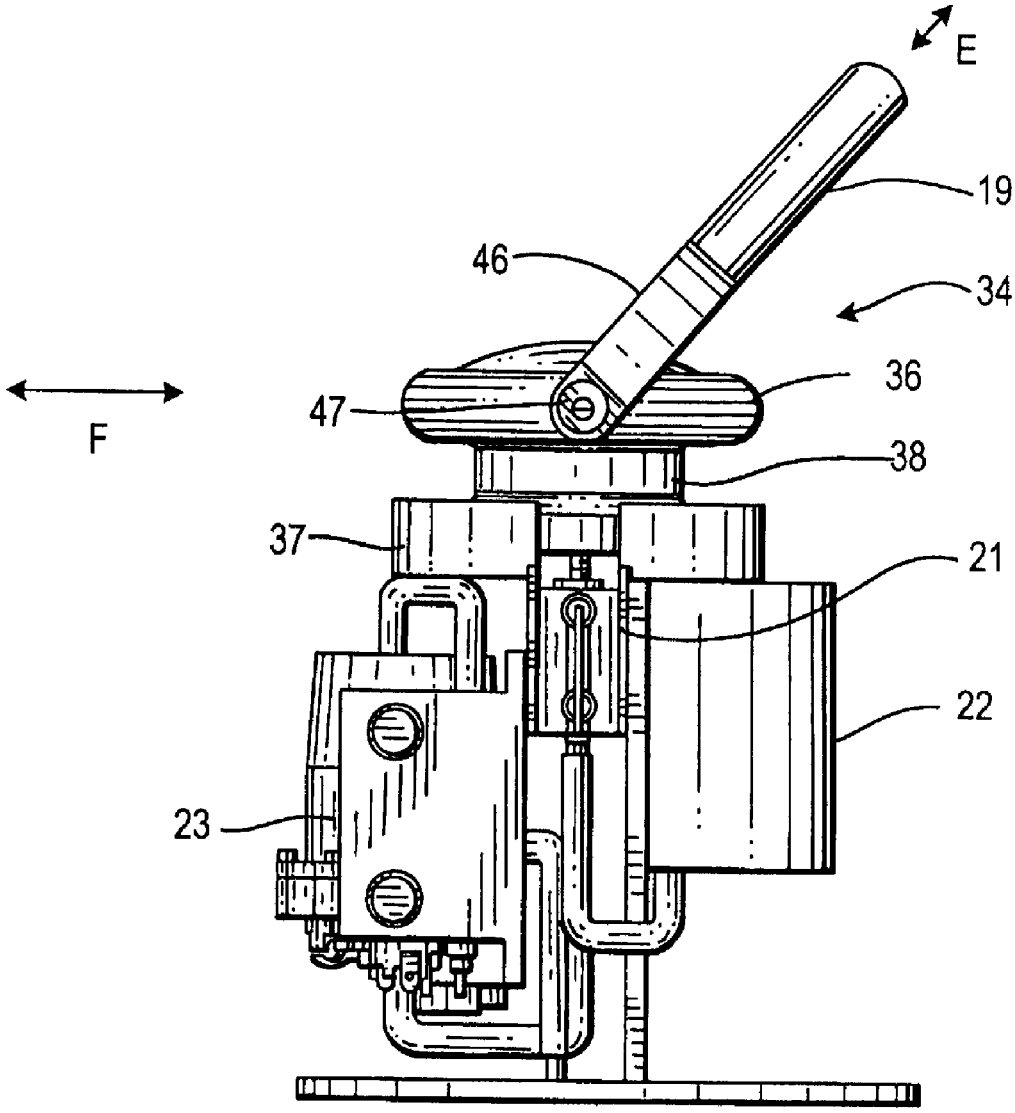
FIG. 9 is a side elevational view showing how movement of the handle displaces the actuator.

FIG. 8 shows how actuator 36 is pivotally mounted to handle connector 19 by an actuator yoke 46. As shown in FIG. 9 movement of handle 13 in a pushing or pulling direction along an arrow E causes actuator 34 to be displaced along a path defined by an arrow F. This will happen as long as the angle between the floor or cleaning surface and pole 14 is not 90°. The resultant force on actuator 34 will drop to zero when the user's force is perpendicular to the floor or cleaning surface. The friction between the floor and mop 11 tries to prevent movement of mop 11 causing the change of position of pump actuator 34 within actuator frame 39 resulting in pumping of water to boiler 23.

Mop 11 as detailed in FIGS. 8 and 9 includes actuator yoke 46 attached to actuator top 36 by a pair of handle ring tabs 47. Ring tabs 47 are made of two halves held together with tabs that insert into yoke 46 connected to handle connector 19.

A fabric steam pad frame is typically placed over steam pad 15 for effective steam cleaning.

Steam mop 11 provides many advantages for ease of use because it eliminates the need for an electric water pump and an on/off switch to activate an electric water pump. Here, the user has more control over the amount of water needed to be discharged into the boiler and consequently, how much steam is needed by moving the mop in any direction. In addition, steam mop 11 is designed as a low pressure or non-pressurized system so it is safer for the user to use. Further, since the amount of water routed to the boiler is controlled, the boiler can create steam in a short amount of time.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

The present invention may be embodied in other specific forms without departing from the spirit or essential attributes of the invention. Accordingly, reference should be made to the appended claims, rather than the foregoing specification, as indicating the scope of the invention. A steam mop having a pump that pumps water from a water container to a steam generator in response to movement of the mop handle with the steam fed to a fabric pocket cover in accordance with the invention provides a vast improvement over electrical pumps. The pump may include a two-way valve that pumps water in response to both the push and pull of the mop.

What is claimed is:

1. An actuator assembly including an actuator body and an actuator frame for actuating a mechanical device, comprising:

an rigid actuator body including a disk shaped section with a flange and having an outer surface with an arcuate depression forming a camming surface;

an actuator frame having a groove for receiving the flange of the actuator body and allowing the actuator flange to move in all transverse directions within the groove, when the actuator is displaced in any direction, and, the camming surface displaces a rigid element biased towards and contacting the camming surface for activating a mechanical device connected to the mechanical device.

2. A steam mop, comprising:

a mop housing with a user handle connected to the housing at one end and a steam frame connected to the other end;

the mop housing including a water container and a water pump having a piston rod for movement to pump water;

a steam generator connected to the output of the water pump, and the output of the steam generator connected to the steam frame;

a rigid actuator body and actuator assembly seated in the housing with the actuator body connected to the mop handle, the assembly including an actuator frame with a grove adapted to receive a flange of the actuator body and allowing the flange to move in all transverse directions within the groove when the actuator body is displaced in any direction;

the actuator body having on outer surface with a depression forming a camming surface facing the the water pump; and the piston rod biased towards and contacting the camming surface, whereby the piston rod moves in response to movement of the actuator within the groove to pump water to the steam generator.

3. The steam mop of claim 2, wherein the water pump is a mechanical piston pump with at least one-way inlet valve and a one-way outlet valve.

4. The steam mop of claim 3, wherein the valves are substantially conical in shape and made of a substantially flexible material.

5. The steam mop of claim 2, wherein the water pump is a two-way mechanical pump, comprising:

a pump cylinder having a first end and a second end with a first unidirectional inlet valve and a second unidirectional inlet valve at the first end and a second unidirectional outlet valve and a second unidirectional outlet valve at the second end;

a piston dividing the cylinder into a first chamber and a second chamber with the respective inlet and outlet valves connected thereto with the first and second inlet valve connected to a water source and the outlet valves connected to a water receiver;

whereby movement of the piston towards the second end expels water out of the second chamber through the second outlet valve and draws water into the first chamber through the first inlet valve and movement of the piston towards the first end expels water out of the first chamber through the first outlet valve and draws water into the second chamber through the second inlet valve.

6. The steam mop of claim 2, wherein the groove in the actuator frame is substantially parallel to the steam frame.

7. The steam mop of claim 2, wherein the depression in the actuator body facing the water pump is substantially arcuate.

8. The actuator assembly of claim 1, wherein the mechanical device is a pump having a piston with a piston rod and the rigid element biased toward the camming surface is the piston nod of the pump.

* * * * *